US007381092B2

(12) United States Patent
Nakada

(10) Patent No.: US 7,381,092 B2
(45) Date of Patent: Jun. 3, 2008

(54) CONNECTOR

(75) Inventor: Kouji Nakada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 151 days.

(21) Appl. No.: 10/585,360

(22) PCT Filed: Mar. 16, 2004

(86) PCT No.: PCT/JP2004/003460

§ 371 (c)(1),
(2), (4) Date: Jul. 6, 2006

(87) PCT Pub. No.: WO2005/067108

PCT Pub. Date: Jul. 21, 2005

(65) Prior Publication Data

US 2007/0155239 A1 Jul. 5, 2007

(30) Foreign Application Priority Data

Jan. 9, 2004 (JP) ..... 2004-004149

(51) Int. Cl.
*H01R 33/76* (2006.01)

(52) U.S. Cl. ..... 439/608

(58) Field of Classification Search ..... 439/608, 439/609, 76.1, 108, 701
See application file for complete search history.

(56) References Cited

U.S. PATENT DOCUMENTS 5,620,340 A * 4/1997 Andrews ..... 439/608
5,664,968 A * 9/1997 Mickievicz ..... 439/608
6,116,926 A * 9/2000 Ortega et al. ..... 439/108
6,184,460 B1 * 2/2001 Bertoncini ..... 174/359
6,220,896 B1 * 4/2001 Bertoncini et al. ..... 439/608
6,431,914 B1 * 8/2002 Billman ..... 439/608
6,471,549 B1 10/2002 Lappöhn
6,478,624 B2 * 11/2002 Ramey et al. ..... 439/608
6,491,545 B1 12/2002 Spiegel et al.
6,517,360 B1 * 2/2003 Cohen ..... 439/65
6,808,414 B2 10/2004 Spiegel et al.
7,267,515 B2 * 9/2007 Lappohn ..... 439/608

(Continued)

FOREIGN PATENT DOCUMENTS

JP 6325829 11/1994

(Continued)

OTHER PUBLICATIONS

Supplementary European Search Report.

*Primary Examiner*—Neil Abrams
*Assistant Examiner*—Phuongchi Nguyen
(74) *Attorney, Agent, or Firm*—Collard & Roe, P.C.

(57) ABSTRACT

A connector having juxtaposed contact modules (6). In each contact module, signal contacts (16), a first ground plate (14), and a second ground plate (15) are held by an insulator (28). The first and second ground plates comprise plate sections (14*a*, 15*a*) each having a first surface and a second surface on the opposite side of the first surface, and the first surfaces face each other. Pairs of protrusions (14*b*, 15*b*) are formed at intervals on the second surfaces of the plate sections. The first and second ground plates are molded in the insulator and integrated together. The insulator has recesses (29) corresponding to the intervals of the protrusions and signal contacts are disposed in the recesses.

10 Claims, 15 Drawing Sheets

U.S. PATENT DOCUMENTS

2005/0118883 A1* 6/2005 Kim ..... 439/701

FOREIGN PATENT DOCUMENTS

| | | | |
|---|---|---|---|
| JP | 2537698 | | 9/1996 |
| JP | 2000-311749 | A | 11/2000 |
| JP | 2001-307817 | A | 11/2001 |
| JP | 2002-42978 | A | 2/2002 |
| JP | 2002-270303 | A | 9/2002 |
| JP | 2003-512706 | | 4/2003 |
| JP | 2003-534629 | T | 11/2003 |
| WO | WO 99/26321 | | 5/1999 |

* cited by examiner (A)

(B)

(C)

(A)

(B)

CONNECTOR

CROSS REFERENCE TO RELATED APPLICATIONS

Applicant claims priority under 35 U.S.C. §119 of Japanese Application No. 2004-004149 filed Jan. 9, 2004. Applicant also claims priority under 35 U.S.C. §365 of PCT/JP2004/003460 filed Mar. 16, 2004. The international application under PCT article 21 (2) was not published in English.

TECHNICAL FIELD

This invention relates to a connector having a plurality of juxtaposed contact modules each configured such that a ground plate partitions between adjacent signal contacts.

BACKGROUND ART

Even in the field where electrical signals have high frequencies, there is a demand for connecting between printed boards by a connector. The subjects required in this case are crosstalk reduction, impedance matching, measures against deviation in propagation time between signals, and so on.

This type of connector is disclosed, for example, in Japanese Unexamined Patent Publication No. H6-325829 and Japanese Patent No. 2537698 and includes a plurality of contact modules each configured such that contacts are held by a mold component. In the manufacture of the contact module, there is a case where the contacts are molded-in with the insulator or a case where the mold component having grooves each with a shape resembling the contact is formed and the contacts are fitted into the grooves. Further, a component having the ground function is attached to each of the contact modules.

The foregoing connector is complicated because there are many assembly processes during the manufacture. Further, when the lengths of lines for transmitting signals are not physically equal among the contact modules, a difficult design is required, such as, adjusting the lengths of the contacts in the mold components and those in the air. Moreover, while pairs of two lines are used, the two lines are unbalanced between them and further a measure to counter crosstalk is difficult.

DISCLOSURE OF THE INVENTION

It is therefore an object of this invention to provide a connector that can easily cope with various problems in the field where electrical signals have high frequencies.

It is another object of this invention to provide a connector that can prevent crosstalk, has a simple structure, and further, is convenient in its manufacture/assembly.

It is still another object of this invention to provide a connector that is configured such that a plurality of signal contacts are formed into units each of two signal contacts forming a differential pair and further a plurality of contact modules are juxtaposed.

According to an aspect of the present invention, there is provided a connector characterized by comprising a plurality of mutually juxtaposed contact modules, each of the contact modules comprising an insulator, signal contacts held by the insulator, a first ground plate held by the insulator, and a second ground plate held by the insulator, the first and second ground plates comprising plate portions having first surface facing each other and second surfaces on the opposite sides of the first surfaces, and pairs of protrusions formed at intervals on the second surfaces of the plate portions, the first and second ground plates being molded-in with the insulator so as to be integrated together, the insulator having recesses corresponding to the intervals of the protrusions, the signal contacts being disposed in the recesses.

According to another aspect of the present invention, there is provided a connector characterized by comprising contact modules each comprise a plurality of signal contacts, a first ground plate, a second ground plate, and an insulator, the ground plates each comprising at least one section-generally-U-shaped portion, the ground plates and the insulator being molded-in so as to be formed integrally with each other such that the section-generally-U-shaped portions face each other alternately at their backs while face outside at their open portions, and the signal contacts being assembled into the section-generally-U-shaped portions, thereby constituting each of the contact modules, the connector being constituted by juxtaposing a plurality of the contact modules in a housing.

BEST MODE FOR CARRYING OUT THE INVENTION

Figure 1:
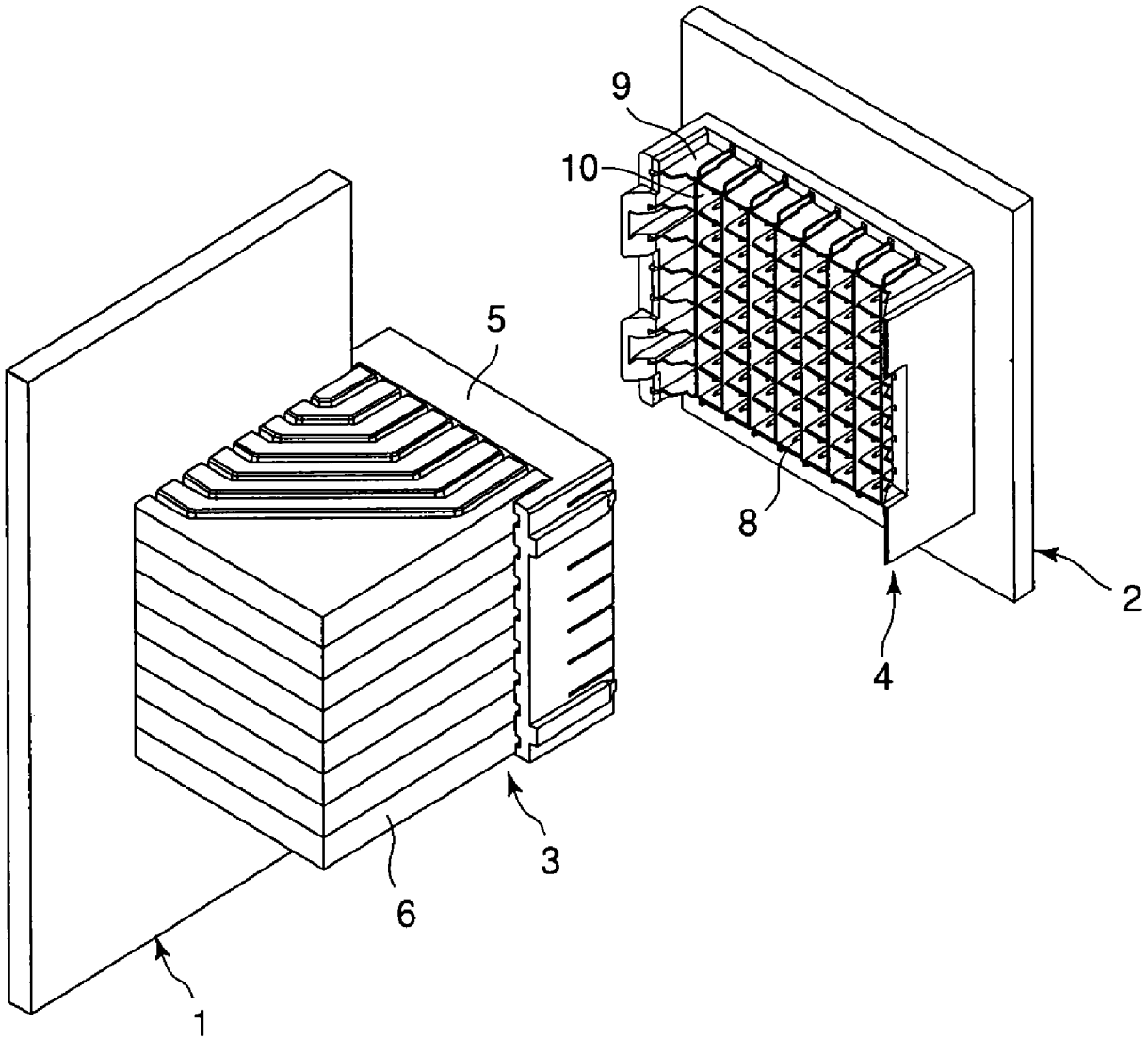
FIG. 1 is a perspective view showing a plug connector as a connector according to one embodiment of this invention along with a backplane, a midplane, and a receptacle connector, before fitting.

Referring to the drawings, a connector according to one embodiment of this invention will be described. This connector is used for transmission of high-speed differential signals.

Figure 2:
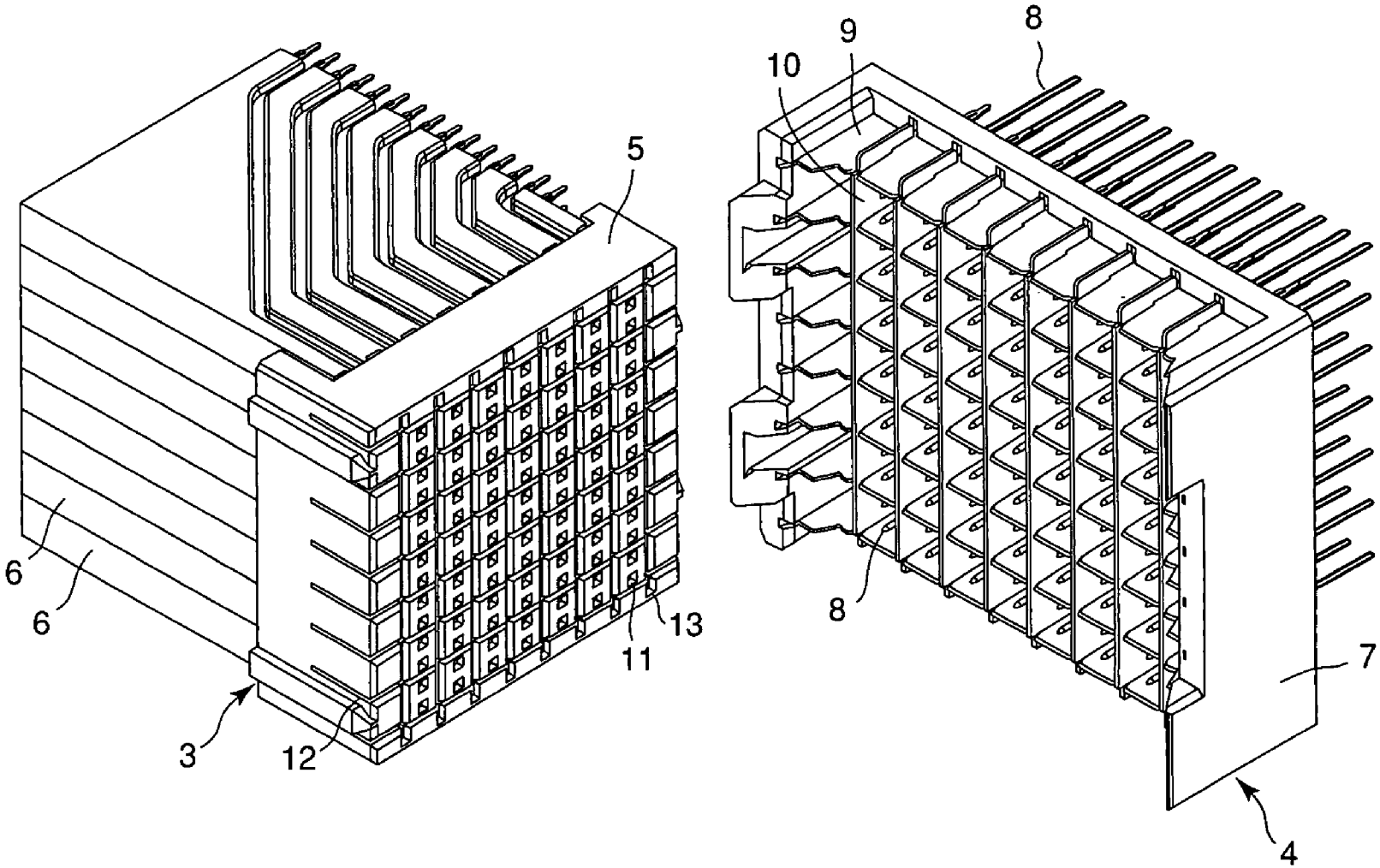
FIG. 2 is a perspective view of the plug connector and the receptacle connector shown in FIG. 1, before fitting.

Referring to FIGS. 1 and 2, there are shown a plug connector 3 press-fitted to a backplane 1 and a receptacle connector 4 press-fitted to a midplane 2. The plug connector 3 and the receptacle connector 4 can be fitted and connected together.

The plug connector 3 comprises an insulating front housing 5 and a plurality of plate-shaped contact modules 6 attached to the front housing 5 in parallel to each other. The receptacle connector 4 comprises an insulating housing 7, a number of, specifically 98, conductive pin headers (7 in vertical direction and 14 in lateral direction) 8 held by the housing 7, eight first ground plates 9 each arranged in the housing 7 in the lateral direction, and eight second ground plates 10 each arranged in the housing in the vertical direction. The first and second ground plates 9 and 10 are each formed by pressing a metal material and thus have conductivity.

Figure 12:
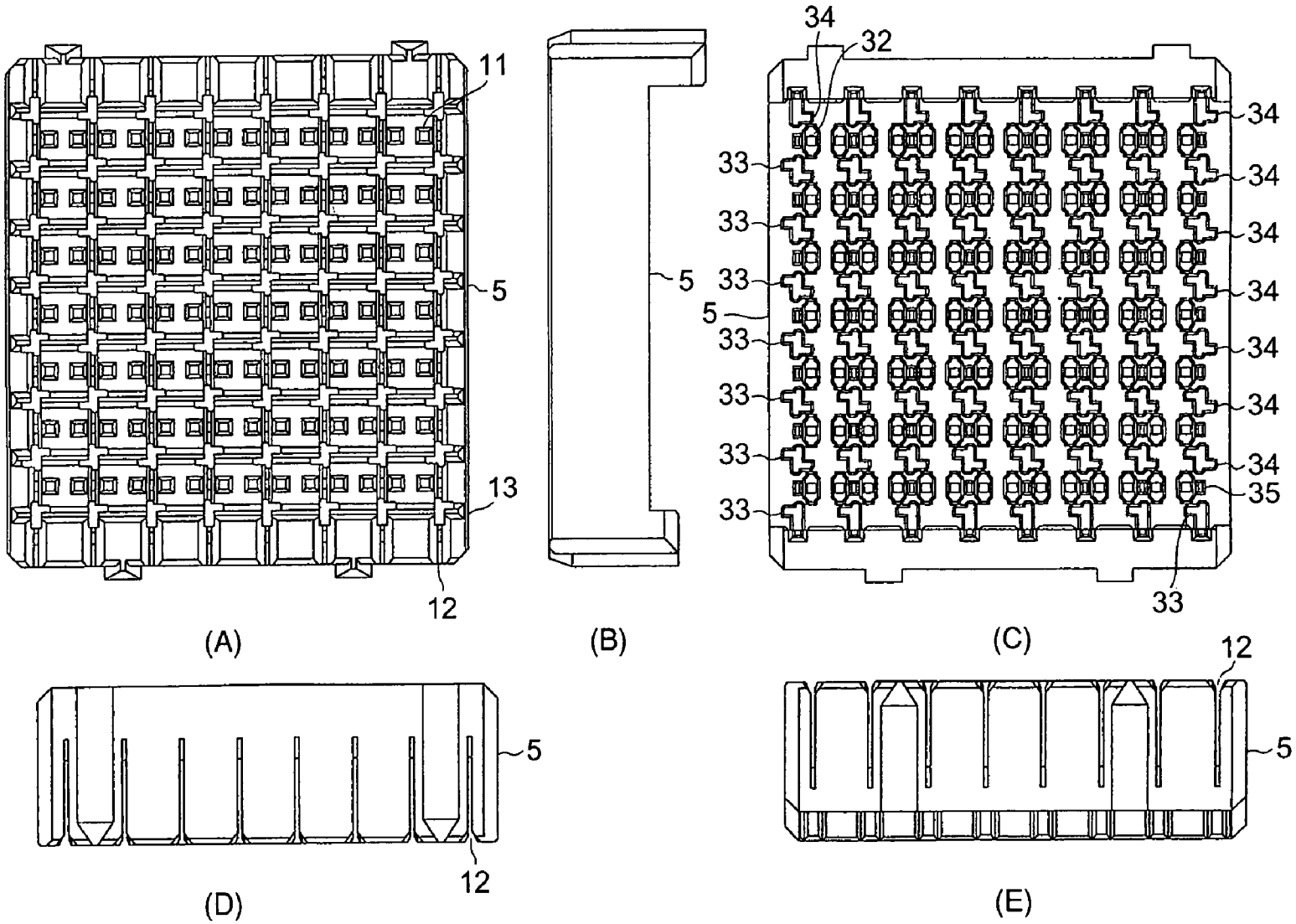
FIG. 12 shows a front housing included in the plug connector of FIG. 1, wherein (A) is a front (fitting surface) view, (B) is a plan view, (C) is a rear (surface opposite to the fitting surface) view, (D) is a left side view, and (E) is a right side view.

The front housing 5 of the plug connector 3 is formed by molding. As also shown in FIG. 12, (A), the plug connector 3 has a fitting surface formed with openings 11 for receiving the pin headers 8 of the receptacle connector 4, eight slits 12 for receiving the eight first ground plates 9, and eight slits 13 for receiving the eight second ground plates 10.

Figure 3:
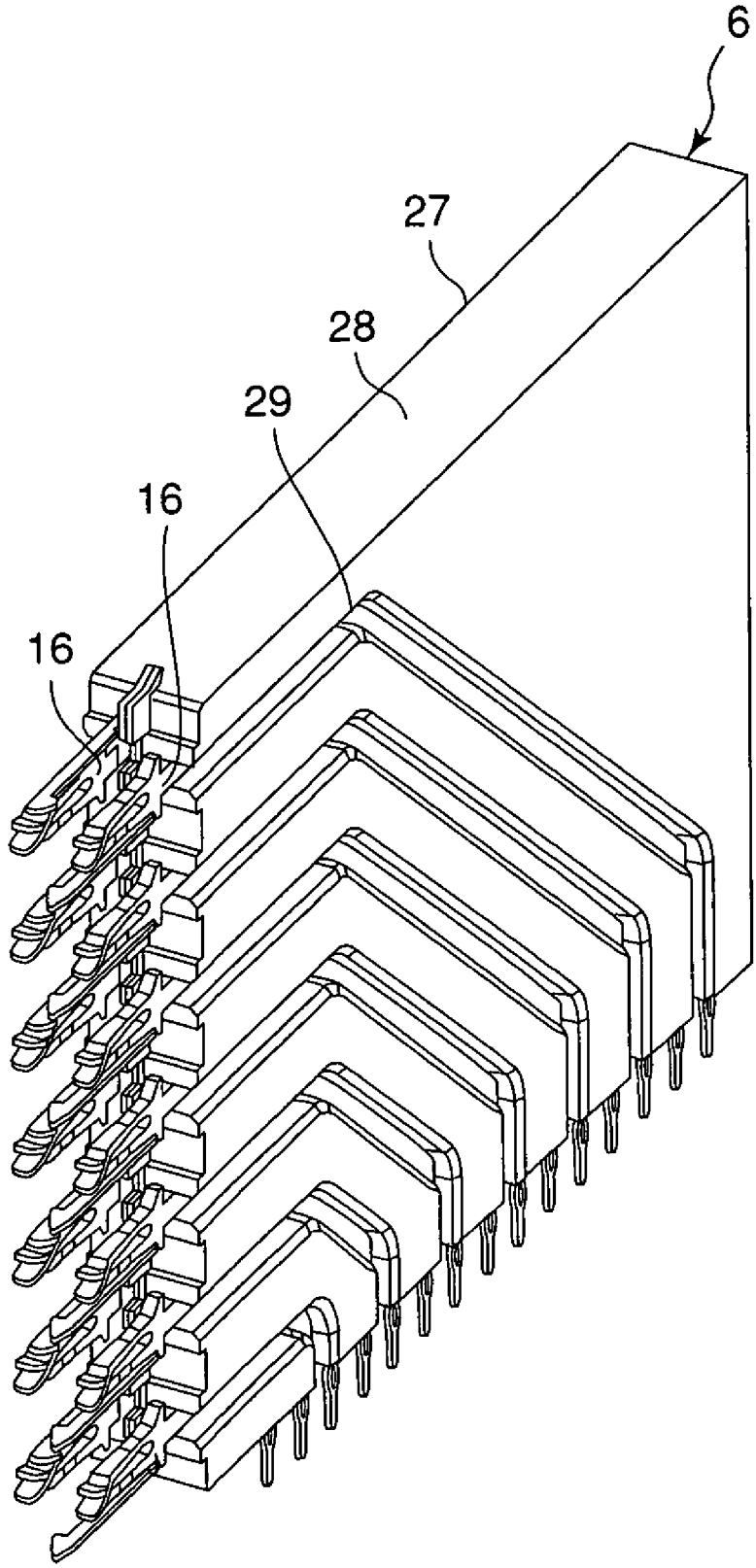
FIG. 3 is a perspective view of a contact module included in the plug connector of FIG. 1.
Figure 4:
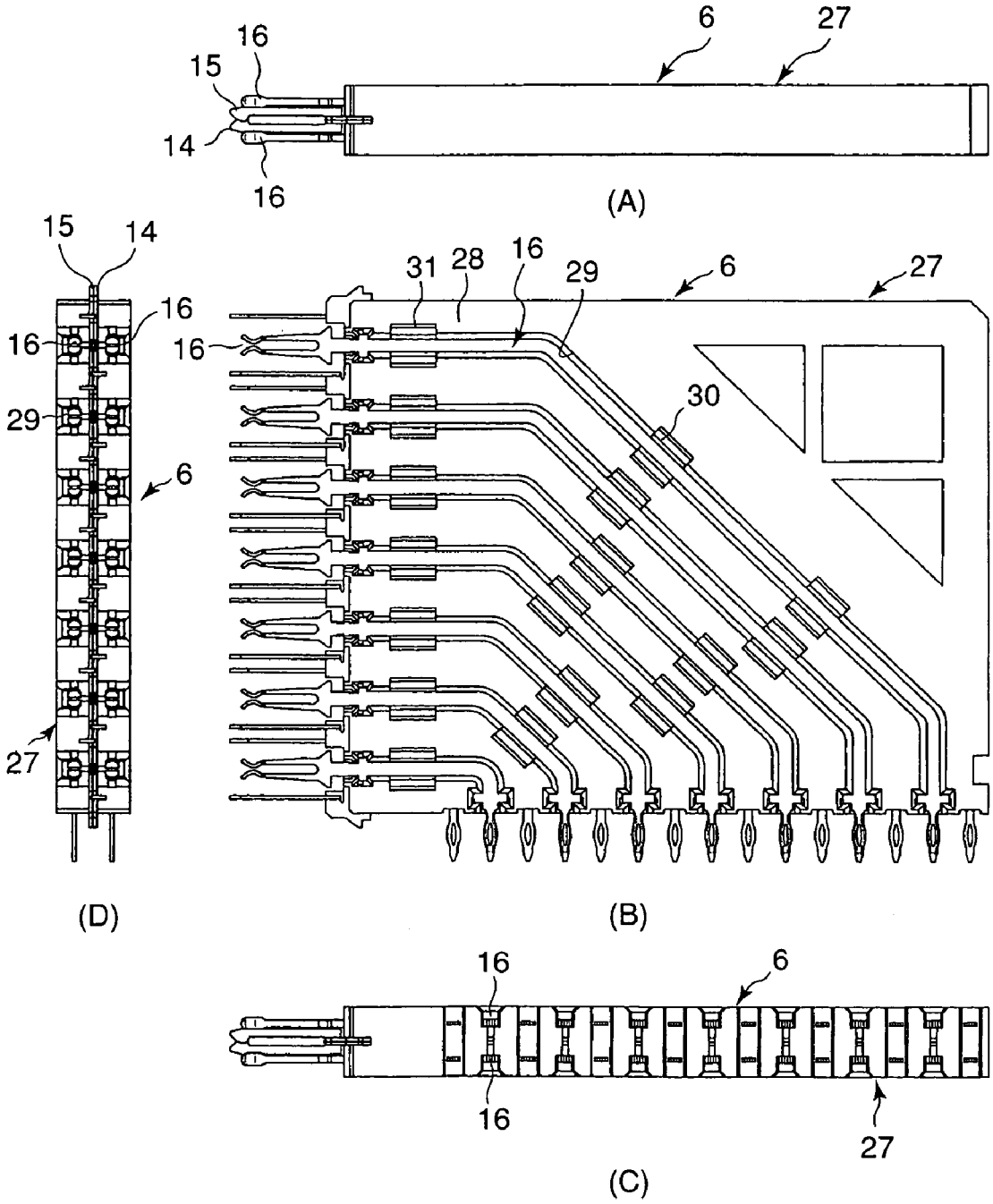
FIG. 4 shows the contact module of FIG. 3, wherein (A) is a plan view, (B) is a front view, (C) is a bottom view, and (D) is a side view.
Figure 5:
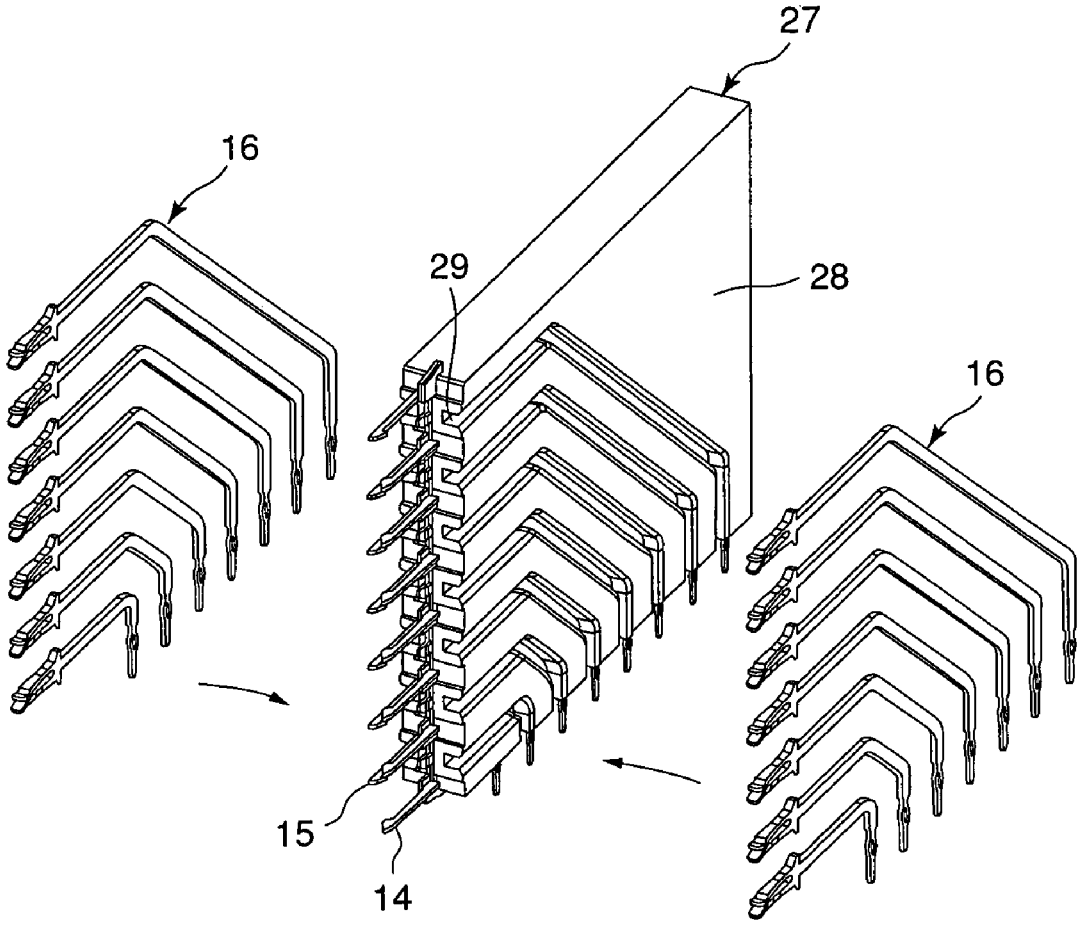
FIG. 5 is an exploded perspective view of the contact module of FIG. 3.
Figure 6:
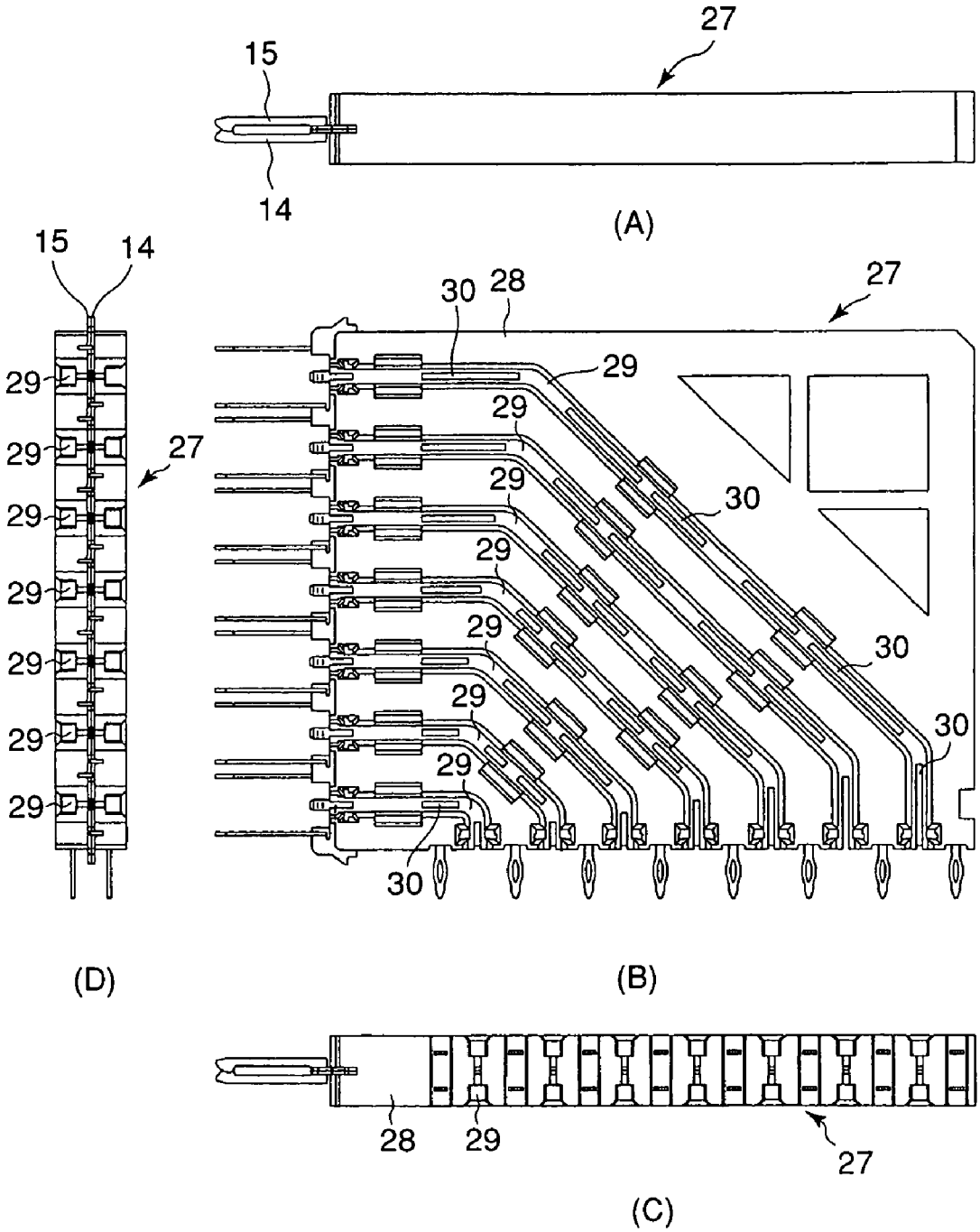
FIG. 6 shows an integrated mold included in the contact module of FIG. 3, wherein (A) is a plan view, (B) is a front view, (C) is a bottom view, and (D) is a side view.

Referring to FIGS. 3, 4, and 5, each of the contact modules 6 comprises an integrated mold 27 formed by molding-in a first ground plate 14 and a second ground plate 15 with a plate-shaped insulator 28, and a plurality of, i.e. long and short seven, conductive signal contacts 16 disposed in a plurality of recesses 29 formed on each of both sides of the insulator 28 and further held by grooves 30. Details of the integrated mold 27 are shown in FIG. 6.

Figure 7:
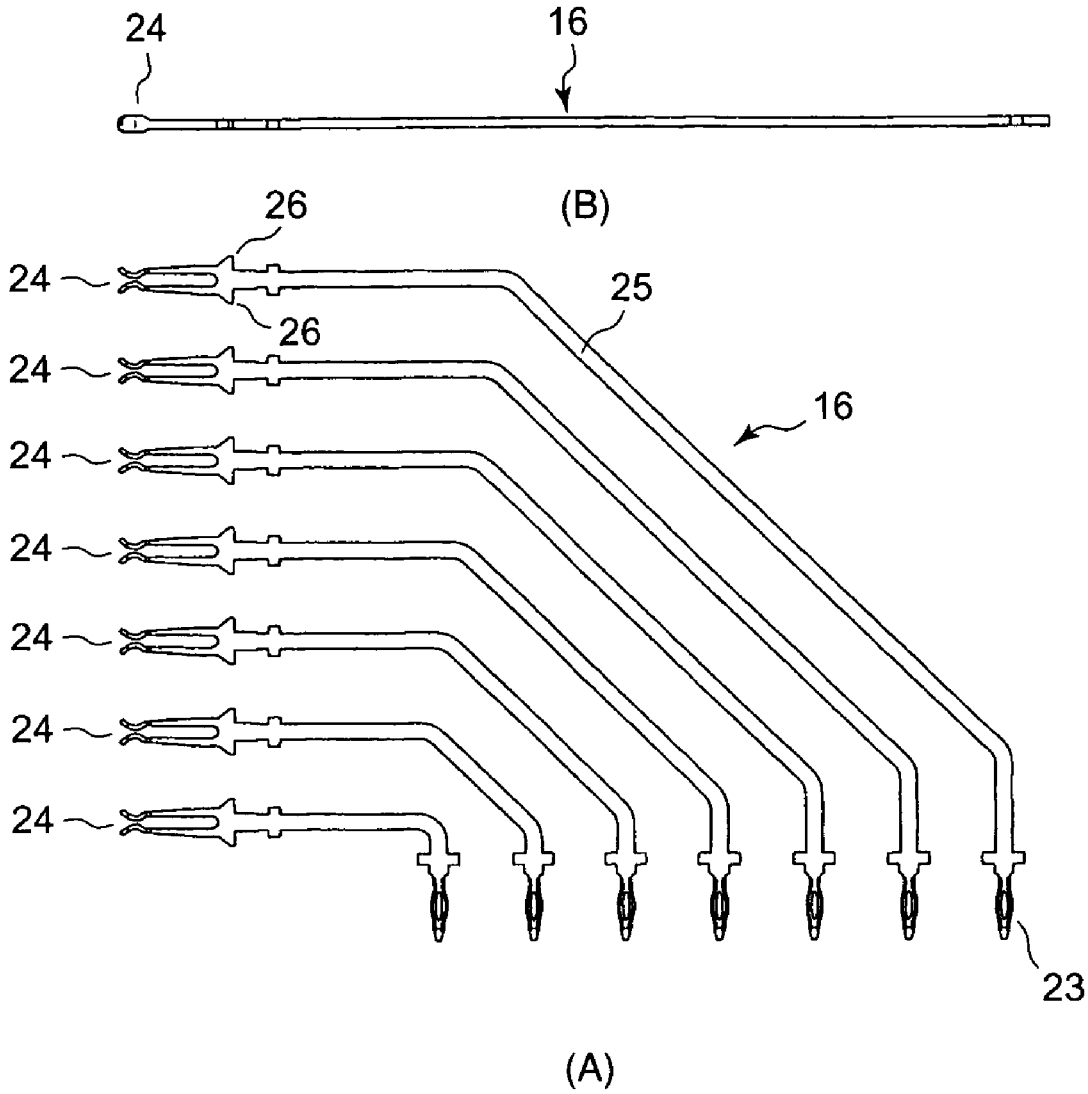
FIG. 7 shows signal contacts included in the contact module of FIG. 3, wherein (A) is a front view of the long and short seven signal contacts and (B) is a side view of the longest signal contact.

Referring to FIG. 7, each of the signal contacts 16 is formed by being bent in sequence or pressed into an angular shape. Each signal contact 16 comprises a press-fit portion 23 for connection to a signal through-hole formed on the backplane 1 shown in FIG. 1, a contact portion 24 for contact with the pin header 8 of the receptacle connector 4, an intermediate portion 25 connecting between the press-fit portion 23 and the contact portion 24, and a press-fit portion 26 to be press-fitted to the front housing 5 of the plug connector 3.

Figure 8:
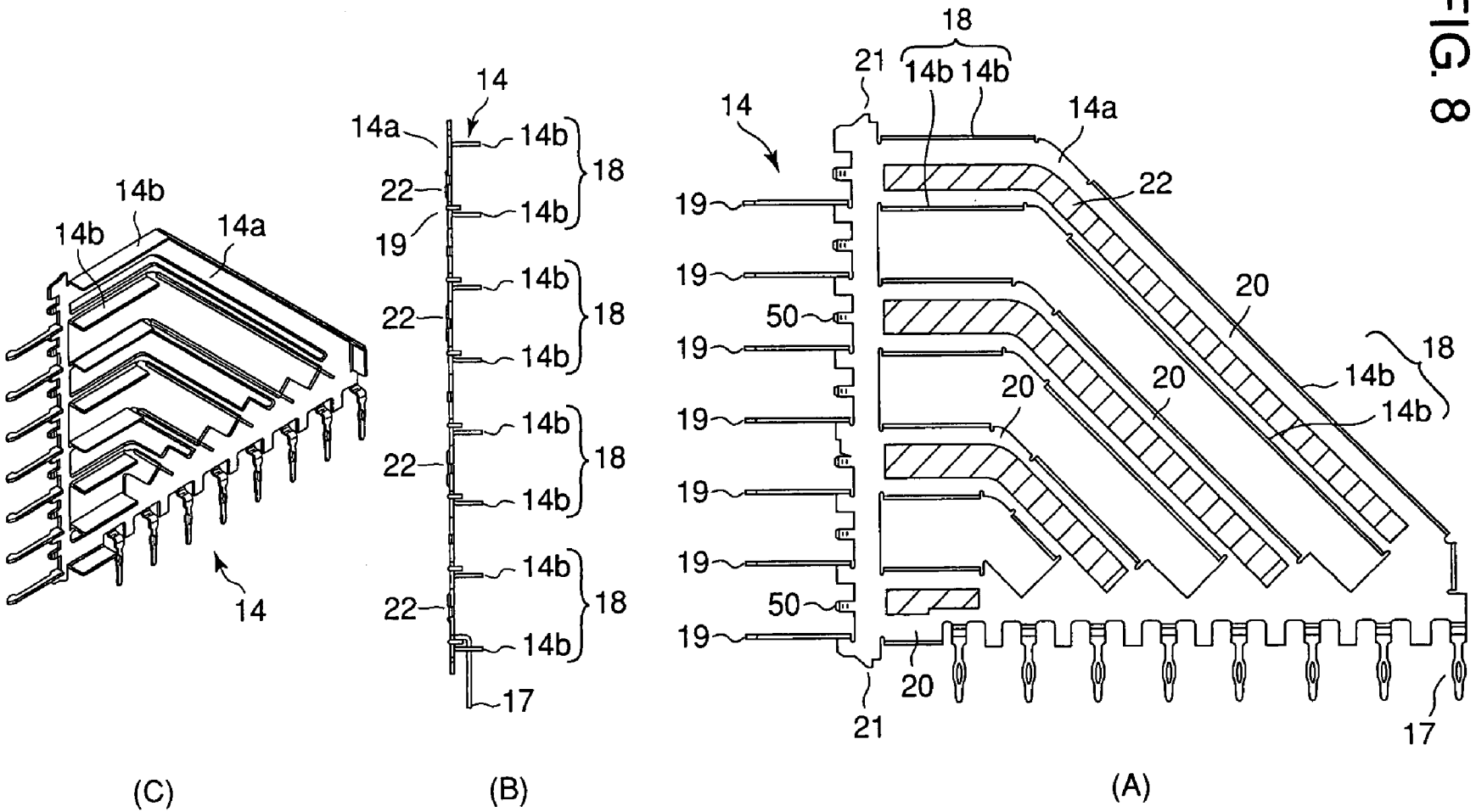
FIG. 8 shows a first ground plate included in the integrated mold of FIG. 6, wherein (A) is a front view, (B) is a side view, and (C) is a perspective view.

As shown in FIG. 8, the first ground plate 14 comprises eight press-fit portions 17 for connection to ground through-holes formed on the backplane 1 shown in FIG. 1, four section-generally-U-shaped portions 18 formed by being bent perpendicularly by notching, seven contact portions 19 for contact with the first ground plate 9 of the receptacle connector 4, four shield intermediate portions 20 connecting between the press-fit portions 17 and the contact portions 19, seven projections 50 adapted to be received in receiving holes 35 of the front housing 5 for reducing crosstalk and adjusting impedance, and a pair of press-fit portions 21 to be press-fitted to the front housing 5 of the plug connector 3. Each shield intermediate portion 20 of the first ground plate 14 is formed with a convex rib 22 in a direction opposite to the bending direction of the generally L-shaped portion 18.

Figure 9:
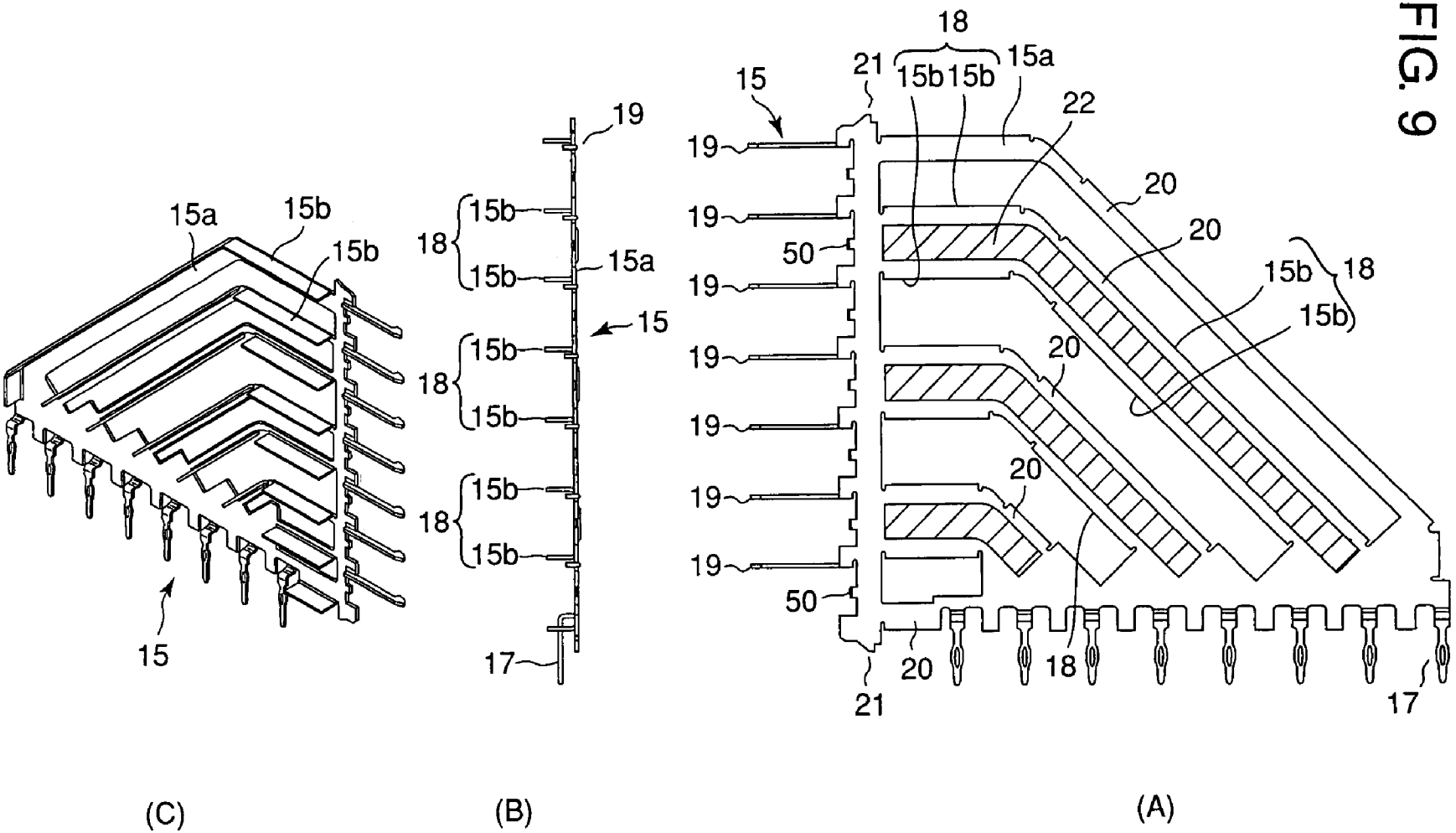
FIG. 9 shows a second ground plate included in the integrated mold of FIG. 6, wherein (A) is a front view, (B) is a side view, and (C) is a perspective view.

The second ground plate 15 has a structure similar to that of the first ground plate 14 and hence the same reference symbols are assigned to similar portions. That is, as shown in FIG. 9, the second ground plate 15 comprises eight press-fit portions 17 for connection to ground through-holes formed on the backplane 1 shown in FIG. 1, four section-generally-U-shaped portions 18 formed by being bent perpendicularly by notching, seven contact portions 19 for contact with the first ground plate 9 of the receptacle connector 4, five shield intermediate portions 20 connecting between the press-fit portions 17 and the contact portions 19, seven projections 50 adapted to be received in receiving holes 35 of the front housing 5, and a pair of press-fit portions 21 to be press-fitted to the front housing 5 of the plug connector 3. Each shield intermediate portion 20 of the second ground plate 15 is formed with a convex rib 22 in a direction opposite to the bending direction of the generally L-shaped portion 18. As compared with the first ground plate 14, the second ground plate 15 differs in bending direction of the press-fit portions 17, position and bending direction of the section-generally-U-shaped portions 18, and position and displacement direction of the contact portions 19.

Referring to FIGS. 8 and 9 along with FIG. 6, the first and second ground plates 14 and 15 will be described in other words.

The first and second ground plates 14 and 15 have plate portions 14*a* and 15*a* each having a first surface and a second surface on the opposite side of the first surface, the first surfaces facing each other, and pairs of protrusions 14*b* and 15*b* formed at intervals on the second surfaces of the plate portions 14*a* and 15*a*. The protrusions 14*b* and 15*b* each protrude from the plate portion 14*a* or 15*a* so as to form a right angle with the second surface. Further, the positions of the intervals between the paired protrusions 14*b* and 15*b* are staggered between the first and second ground plates 14 and 15. Moreover, in each of the first and second ground plates 14 and 15, the paired protrusions 14*b* or 15*b* and a portion of the plate portion 14*a* or 15*a* corresponding to the interval therebetween cooperatively define a generally U shape in section thereof, thereby forming the section-generally-U-shaped portion 18.

Figure 10:
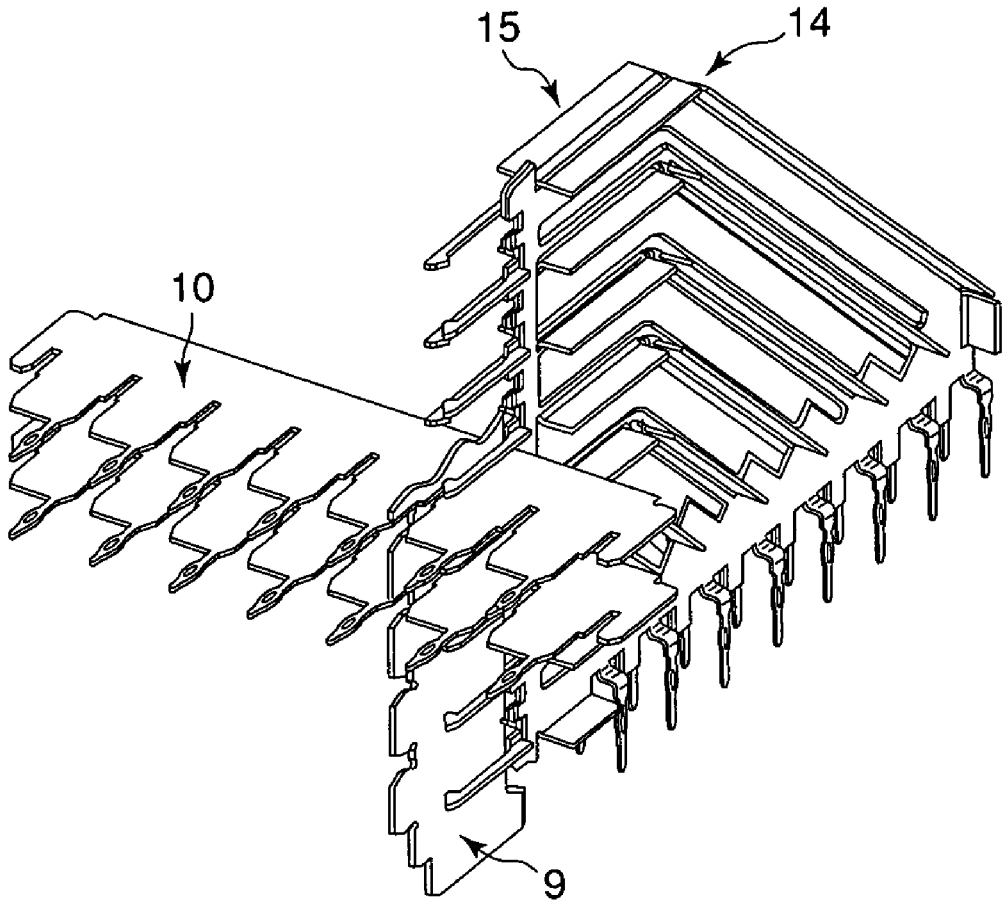
FIG. 10 is a perspective view showing a connected state of the first and second ground plates shown in FIGS. 8 and 9.

When the plug connector 3 and the receptacle connector 4 are connected together, the first and second ground plates 14 and 15 of the plug connector 3 and the first and second ground plates 9 and 10 of the receptacle connector 4 are connected in the state as shown in FIG. 10.

As methods of assembling the signal contacts 16 into the insulator 28 of the integrated mold 27, there are the following methods 1 to 3 as examples.

1. As shown in FIGS. 3, 5, and 6, the seven recesses 29 are formed on each of both sides of the insulator 28 of the integrated mold 27 and the signal contacts 16 are press-fitted into the recesses 29, respectively.

Figure 11:
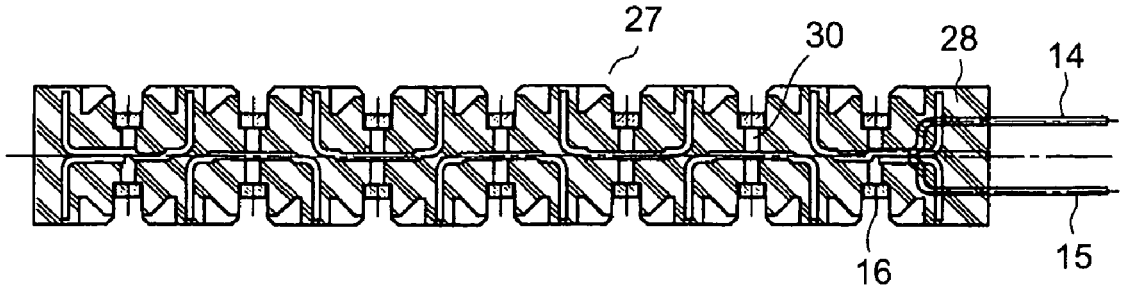
FIG. 11 shows a method of obtaining the contact module by assembling the signal contacts into the integrated mold of FIG. 6, wherein (A) is a sectional view of the state where the signal contacts are assembled into the integrated mold, (B) is a main-part enlarged sectional view showing an operation of caulking an insulator of the integrated mold by the use of a jig, and (C) is a sectional view of the completed contact module.
Figure 11:
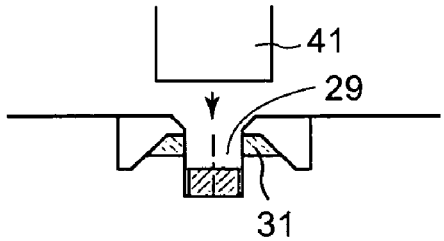
Figure 11:
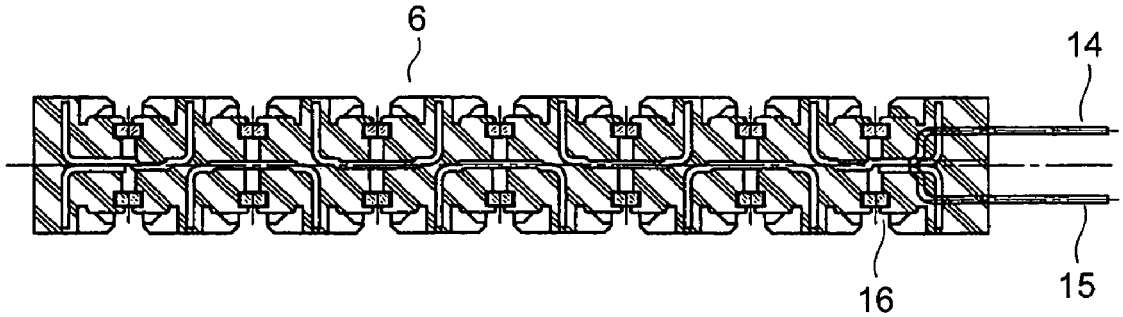

2. As shown in FIGS. 4 and 11, the insulator 28 of the integrated mold 27 is integrated with the molded-in first and second ground plates 14 and 15 and further formed with the recesses 29 at mounting portions of the signal contacts 16. After inserting the signal contacts 16 into the respective recesses 29 as shown in FIG. 11, (A), a portion 31 near an entrance of each recess 29 of the insulator 28 of the integrated mold 27 is crushed by the use of a jig 41 as shown in FIG. 11, (B). Then, as shown in FIG. 11, (C), the signal contacts 16 are caulked and fixed to the integrated mold 27 so that the contact module 6 is completed.

3. The signal contacts 16 are inserted into the respective recesses 29 on both sides of the integrated mold 27 and then integrated together further by molding.

Each of the signal contacts 16 assembled on one side of the integrated mold 27 and each of the signal contacts 16 assembled on the other side thereof may have the same structure. Grooves 30 shown in FIG. 11 are adapted to carry out impedance adjustment, transmission signal speed adjustment, or the like.

As shown in FIG. 12, (C), the surface, opposite to the fitting surface, of the front housing 5 of the plug connector 3 is provided with receiving holes 32 for receiving the contact portions 24 of the signal contacts 16, receiving holes 33 for receiving the contact portions 19 of the first ground plate 14, and receiving holes 34 for receiving the contact portions 19 of the second ground plate 15, wherein the receiving hole 33 and the receiving hold 34 are continuous with each other. When the eight contact modules 6 are collectively press-fitted to the rear side of the front housing 5, the plug connector 3 is completed.

Figure 13:
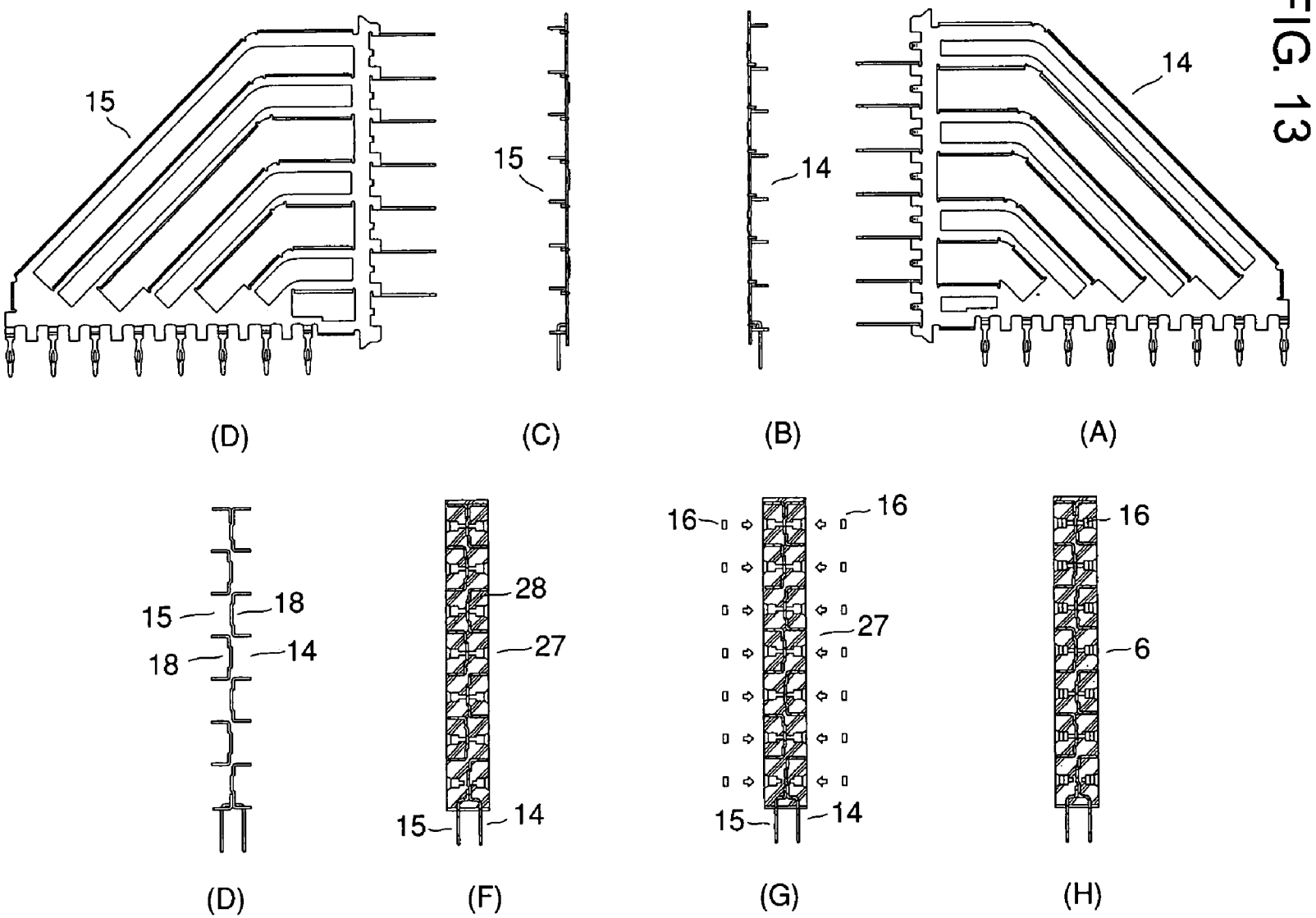
FIG. 13 shows manufacture/assembly processes of the contact module of FIG. 3 sequentially in (A) to (H), respectively.

FIG. 13, (A) to (H) are manufacture/assembly diagrams of the contact module 6 of the plug connector 3. At first, as shown in FIG. 13, (E), the first and second ground plates 14 and 15 are disposed so that the section-generally-U-shaped portions 18 of the ground plates 14 and 15 face each other alternately at their backs while face outside at their open portions. Then, as shown in FIG. 13, (F), both ground plates 14 and 15 and the insulator 28 are molded-in so as to be formed integrally with each other, so that the integrated mold 27 is constituted. Subsequently, as shown in FIG. 13, (G), the signal contacts 16 are inserted into the section-generally-U-shaped portions 18 and then caulked to the insulator 28 by the use of the jig. Then, as shown in FIG. 13, (H), the contact module 6 is completed. By juxtaposing the eight contact modules 6 in the front housing 5, the plug connector 3 is constituted.

Figure 14:
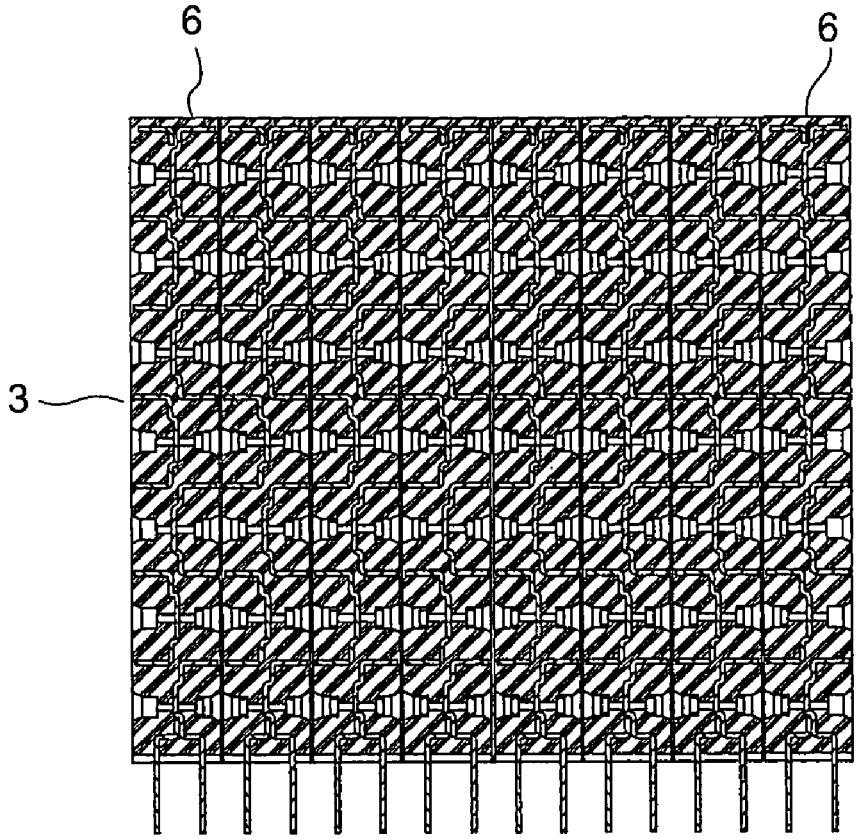
FIG. 14 shows the contact modules of FIG. 3, wherein (A) is an overall sectional view and (B) is an enlarged sectional view of a portion thereof.
Figure 14:
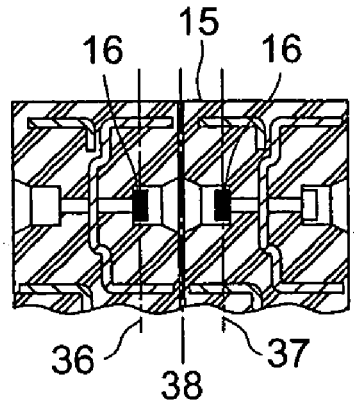

FIG. 14, (A) is a sectional view of the inside of the front housing 5 of the plug connector 3 and FIG. 14, (B) is an enlarged view of a portion thereof. The two signal contacts 16 forming each of differential pairs surrounded by the first ground plate 14 and the second ground plate 15 in a lattice fashion are arranged symmetrical to a center plane 38 parallel to planes 36 and 37 which include the two signal contacts 16, respectively. Therefore, since the lines are structurally symmetric and there is no difference in line length, the present connector is strengthened in resistance against noise signals and is capable of carrying out differential transmission by the use of balanced transmission lines effective for suppressing generation of noise to the exterior.

On the left side of the leftmost contact module 6 and on the right side of the rightmost contact module 6 in FIG. 14, (A), since there are no ground plates that surround the left outside and the right outside thereof, no signal contacts are assembled there.

Figure 15:
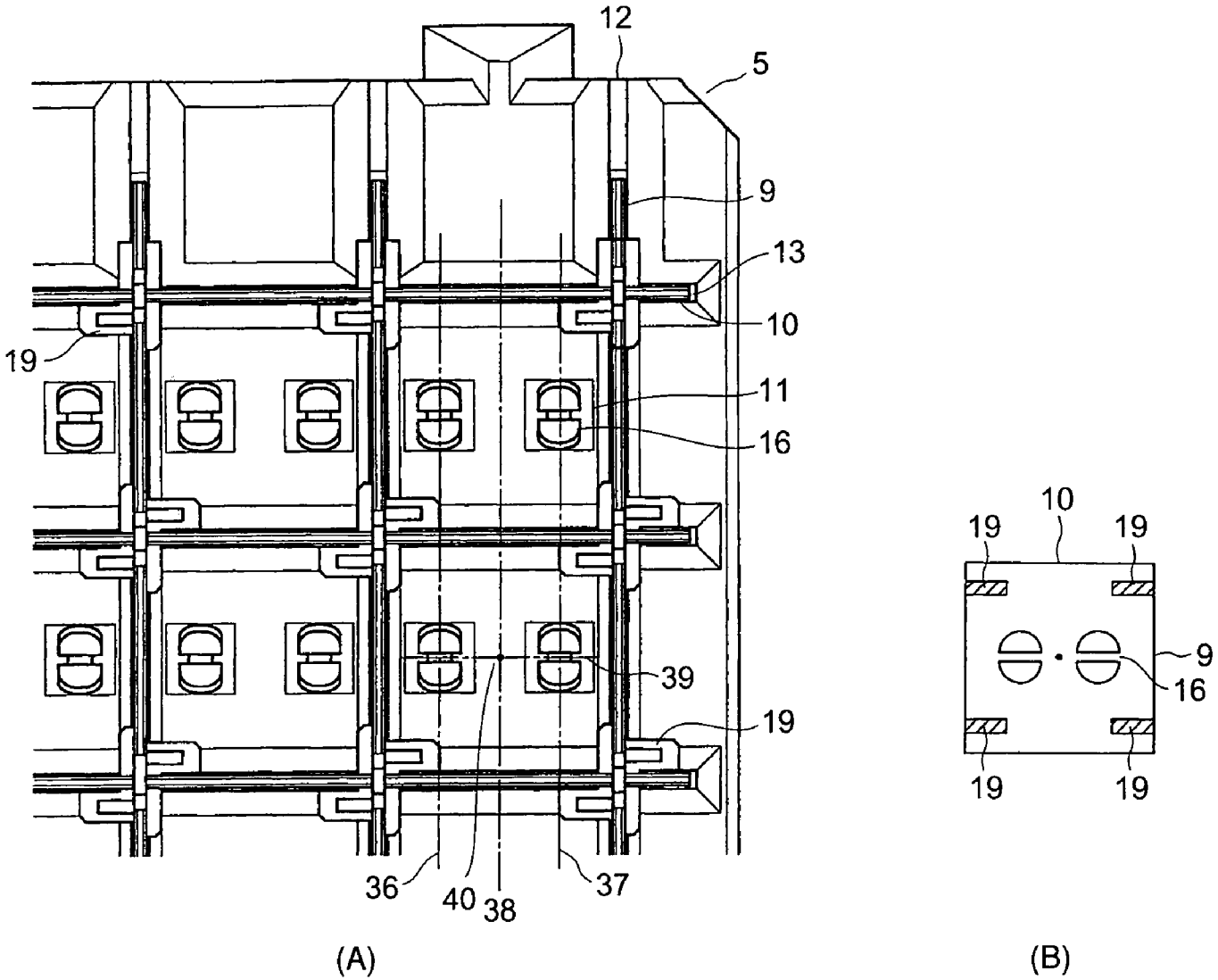
FIG. 15 exemplarily shows the state where the plug connector and the receptacle connector of FIG. 2 are fitted together, wherein (A) is a sectional view of a portion thereof and (B) is an enlarged sectional view of one design modification of the structure shown in (A).

FIG. 15, (A) is an exemplary sectional view of the state where the plug connector 3 and the receptacle connector 4 are fitted together. However, the housing 7 and the pin headers 8 of the receptacle connector 4 are not illustrated. The first ground plates 9 of the receptacle connector 4 are received in the slits 12 of the front housing 5 of the plug connector 3 and the second ground plates 10 of the receptacle connector 4 are received in the slits 13. A plane 39 connecting between the two signal contacts 16 forming each differential pair perpendicularly crosses the center plane 38 at an intersection point 40. At each two diagonal corners formed by the first ground plates 9 and the second ground plates 10 of the receptacle connector 4 which surround the differential pairs of two signal contacts 16 in a lattice fashion, there are provided the contact portions 19 of the first ground plate 14 and the second ground plate 15 of the plug connector 3. The contact portions 19 of the first ground plate 14 and the contact portions 19 of the second ground plate 15 of the plug connector 3 are connected to the first ground plates 9 of the receptacle connector 4, respectively.

FIG. 15, (B) is one design modification of the structure shown in FIG. 15, (A). At each four corners formed by the first ground plates 9 and the second ground plates 10 surrounding the differential pairs of two signal contacts 16 in the lattice fashion, the contact portions 19 are provided, respectively.

By adjusting the convex ribs 22 of the shield intermediate portions 20 of the first ground plate 14 and the second ground plate 15 or adjusting the punching shapes of the ground plates 14 and 15, it is possible to achieve the characteristic impedance matching between two signal lines. Further, by adjusting the balance between a dielectric and an air layer surrounding the signal contacts 16 by means of the shapes of the recesses 29 of the integrated mold 27 where the signal contacts 16 are fitted, respectively, and of the grooves 30, the impedance matching can be achieved and the transmission signal speed can be adjusted.

According to the foregoing connector, the following effects are exhibited.

1. Since the signal contacts are surrounded by the two ground plates, the crosstalk is effectively prevented.

2. Since the lines are structurally symmetric and there is no difference in line length, the present connector is strengthened in resistance against noise signals and is capable of carrying out differential transmission by the use of balanced transmission lines effective for suppressing generation of noise to the exterior.

3. Since the contact module is composed of the plurality of signal contacts, the two ground plates, and the insulator, the structure is simple.

4. When the combined two ground plates and the insulator are molded-in so as to be formed integrally with each other, the integrated mold is constituted and then, when the signal contacts are assembled into the integrated mold, the contact module is completed. When the plurality of contact modules are juxtaposed in the housing, the connector is constituted. Therefore, the manufacture/assembly of the connector is convenient.

The invention claimed is:

1. A connector comprising a plurality of mutually juxtaposed contact modules, each of said contact modules comprising:

an insulator;

signal contacts held by said insulator;

a first ground plate held by said insulator; and a second ground plate held by said insulator;

said first and second ground plates comprising:

plate portions having first surface facing each other and second surfaces on the opposite sides of said first surfaces; and pairs of protrusions formed at intervals on said second surfaces of said plate portions;

said first and second ground plates being molded-in with said insulator so as to be integrated together;

said insulator having recesses corresponding to the intervals of said protrusions;

said signal contacts being disposed in said recesses.

2. The connector according to claim 1, wherein each of said protrusions protrudes from said plate portion so as to form a right angle with said second surface.

3. The connector according to claim 1, wherein positions of the intervals between said protrusions are staggered between said first and second ground plates.

4. A connector according to a claim 1, wherein, in each of said first and second ground plates, said paired protrusions and a portion of said plate portion corresponding to said interval cooperatively define a generally U shape in section thereof.

5. The connector according to claim 1, wherein at least one of said first and second ground plates has at least one contact portion for connection to a ground plate included in a mating connector.

6. A connector comprising contact modules, each of said contact modules comprising:

a plurality of signal contacts;

a first ground plate;

a second ground plate; and an insulator;

each of said ground plates comprising at least one section-generally-U-shaped portion;

said ground plates and said insulator being molded-in so as to be formed integrally with each other such that said section-generally-U-shaped portions face each other alternately at their backs while face outside at their open portions; and said signal contacts being assembled into said section-generally-U-shaped portions, thereby constituting each of said contact modules;

said connector being constituted by juxtaposing a plurality of said contact modules in a housing.

7. The connector according to claim 6, wherein:

said signal contacts are formed into units each of the two signal contacts forming a differential pair and said two signal contacts are arranged symmetrical to a center plane; and said signal contacts are surrounded by said first ground plate and said second ground plate in a lattice fashion on the basis of said units each of the two signal contacts.

8. The connector according to claim 6, wherein at least one of said ground plates has at least one contact portion for connection to a ground plate of a mating connector.

9. The connector according to claim 8, wherein said contact portions are respectively provided at each two diagonal corners formed by said first ground plate and said second ground plate surrounding said units each of the two signal contacts in the lattice fashion.

10. The connector according to claim 8, wherein said contact portions are respectively provided at each four corners formed by said first ground plate and said second ground plate surrounding said units each of the two signal contacts in the lattice fashion.

* * * * *